US006976380B1

(12) United States Patent
Hartwig, Jr. et al.

(10) Patent No.: US 6,976,380 B1
(45) Date of Patent: Dec. 20, 2005

(54) DEVELOPING THE TEXTURE OF A MATERIAL

(75) Inventors: Karl T. Hartwig, Jr., College Station, TX (US); Simone Leipert, Gelsenkirchen (DE)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/350,823

(22) Filed: Jan. 24, 2003

Related U.S. Application Data

(60) Provisional application No. 60/351,486, filed on Jan. 24, 2002.

(51) Int. Cl.[7] ..... B21C 23/00
(52) U.S. Cl. ..... 72/253.1; 72/257; 72/342.1
(58) Field of Search ..... 72/342.1; 11/700; 148/668, 679, 680, 681, 684

(56) References Cited

U.S. PATENT DOCUMENTS

| | | | | |
|---|---|---|---|---|
| 5,400,633 | A * | 3/1995 | Segal et al. | 72/272 |
| 5,513,512 | A * | 5/1996 | Segal | 72/253.1 |
| 5,590,389 | A | 12/1996 | Dunlop et al. | 419/67 |
| 5,826,456 | A * | 10/1998 | Kawazoe et al. | 72/253.1 |
| 5,904,062 | A * | 5/1999 | Semiatin et al. | 72/253.1 |
| 6,723,187 | B2 * | 4/2004 | Segal et al. | 148/538 |
| 2001/0047838 | A1 * | 12/2001 | Segal et al. | 148/437 |
| 2003/0052000 | A1 * | 3/2003 | Segal et al. | 204/298.13 |

OTHER PUBLICATIONS

M.A. Gibbs, et al., "*Texture Formation In Bulk Iron Processed By Simple Shear*", Pergamon, PII S1359-6462(98) 00384-4, Scripta Materialia, vol. 39, No. 12, Elsevier Science Ltd., Copyright 1998 Acta Metallurgica Inc., pp. 1699-1704, 1998.

S. R. Agnew, et al., "*Texture Evolution During Equal Channel Angular Forging And Dislocation Boundary Misorientations After Severe Plastic Deformation*", Proceedings of the 19th Risø International Symposium on Materials Science: Modelling of Structure and Mechanics of Materials from Microscale to Product, Editors: J. V. Carstensen, et al., Risø National Laboratory, Roskilde, Denmark, pp. 201-206.

* cited by examiner

*Primary Examiner*—Ed Tolan
(74) *Attorney, Agent, or Firm*—Baker Botts L.L.P.

(57) ABSTRACT

Developing a texture of a material includes receiving a billet of material having an initial texture. The billet is associated with an extrusion procedure having extrusion routes executed as passes. The following is repeated for each pass to transform the initial texture to a developed texture: the billet is extruded through an inlet channel of an equal channel angular extrusion die according to the routes, and the billet is extruded through an outlet channel of the equal channel angular extrusion die according to the extrusion routes.

20 Claims, 2 Drawing Sheets

FIRST PASS
INITIAL ORIENTATION

FIRST PASS
COMPLETED

ORIENTATION AT START
OF SECOND EXTRUSION
(ROUTE A)

ORIENTATION AT START
OF SECOND EXTRUSION
(ROUTE B)

ORIENTATION AT START
OF SECOND EXTRUSION
(ROUTE C)

DEVELOPING THE TEXTURE OF A MATERIAL

RELATED APPLICATIONS

This application claims benefit under 35 U.S.C. § 119(e) of U.S. Provisional Application Ser. No. 60/351,486, entitled "METHOD FOR TEXTURE DEVELOPMENT IN BULK MATERIALS,", filed Jan. 24, 2002.

TECHNICAL FIELD OF THE INVENTION

The present invention relates generally to materials processing and more particularly to developing the texture of a material.

BACKGROUND OF THE INVENTION

The texture of material formed by bulk casting is typically non-uniform, which may be undesirable for many manufacturing processes. Known techniques for developing the texture of a material to improve uniformity include rolling, drawing, forging, and extrusion procedures. These techniques typically plastically deform material to reduce the recrystallized grain size and homogenize the microstructure. The known techniques, however, often produce non-uniform strain, non-uniform recrystallized microstructures and unwanted or non-uniform texture, which may be problematic for some applications. As a result, known techniques for developing the texture of a material may be inadequate for many needs.

SUMMARY OF THE INVENTION

According to one embodiment of the present invention, developing a texture of a material includes receiving a billet of material having an initial texture. The billet is associated with an extrusion procedure having extrusion routes executed as passes. The following is repeated for each pass to transform the initial texture to a developed texture: the billet is extruded through an equal channel angular extrusion die one or more times.

Certain embodiments of the invention may provide one or more technical advantages. A technical advantage of one embodiment may be that a uniform texture can be produced throughout the cross section or volume of a workpiece. Uniform microstructure such as uniform grain size and grain morphology may also be produced. The resulting texture and microstructure may be independent of the initial texture and microstructure of the workpiece.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the invention, reference is now made to the following description, taken in conjunction with the accompanying drawings, in which.

DETAILED DESCRIPTION OF THE INVENTION

Figure 1:
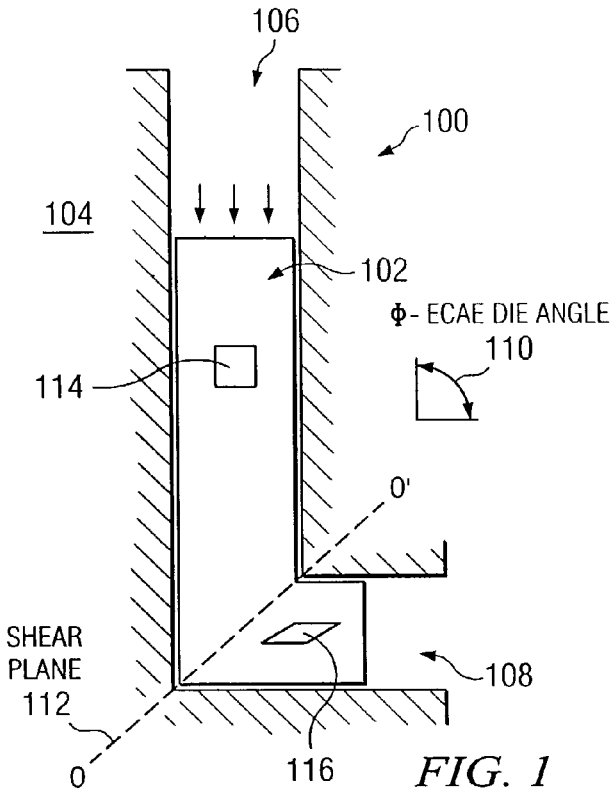
FIG. 1 is a schematic of one embodiment of an equal channel angular extrusion (ECAE) system for developing the texture of a material.
Figure 2A:
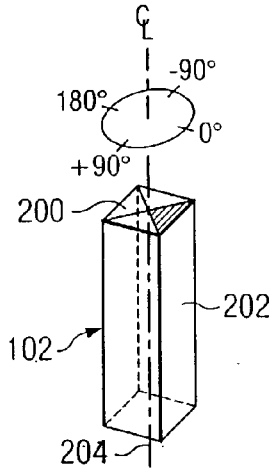
FIGS. 2A through 2E illustrate billet orientations during embodiments of multiple pass ECAE processing: 2A) initial billet orientation, 2B) first extrusion completed, 2C) orientation for second and subsequent extrusions via Route A, 2D) orientation for second extrusion via Route B, and 2D) orientation for second extrusion via Route C.
Figure 2B:
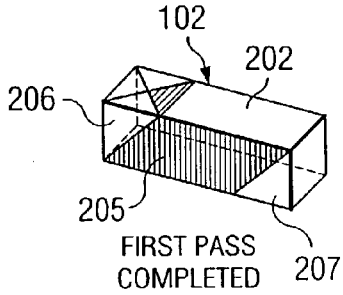
Figure 2C:
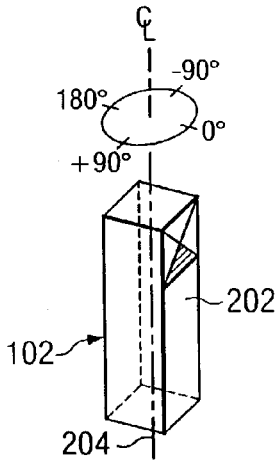
Figure 2D:
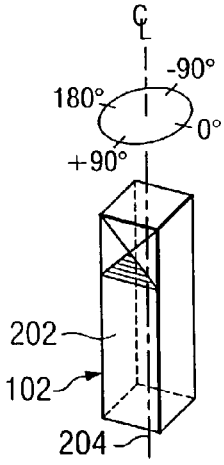
Figure 2E:
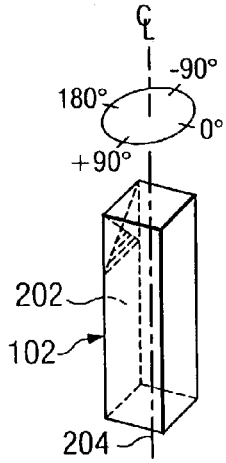
Figure 3:
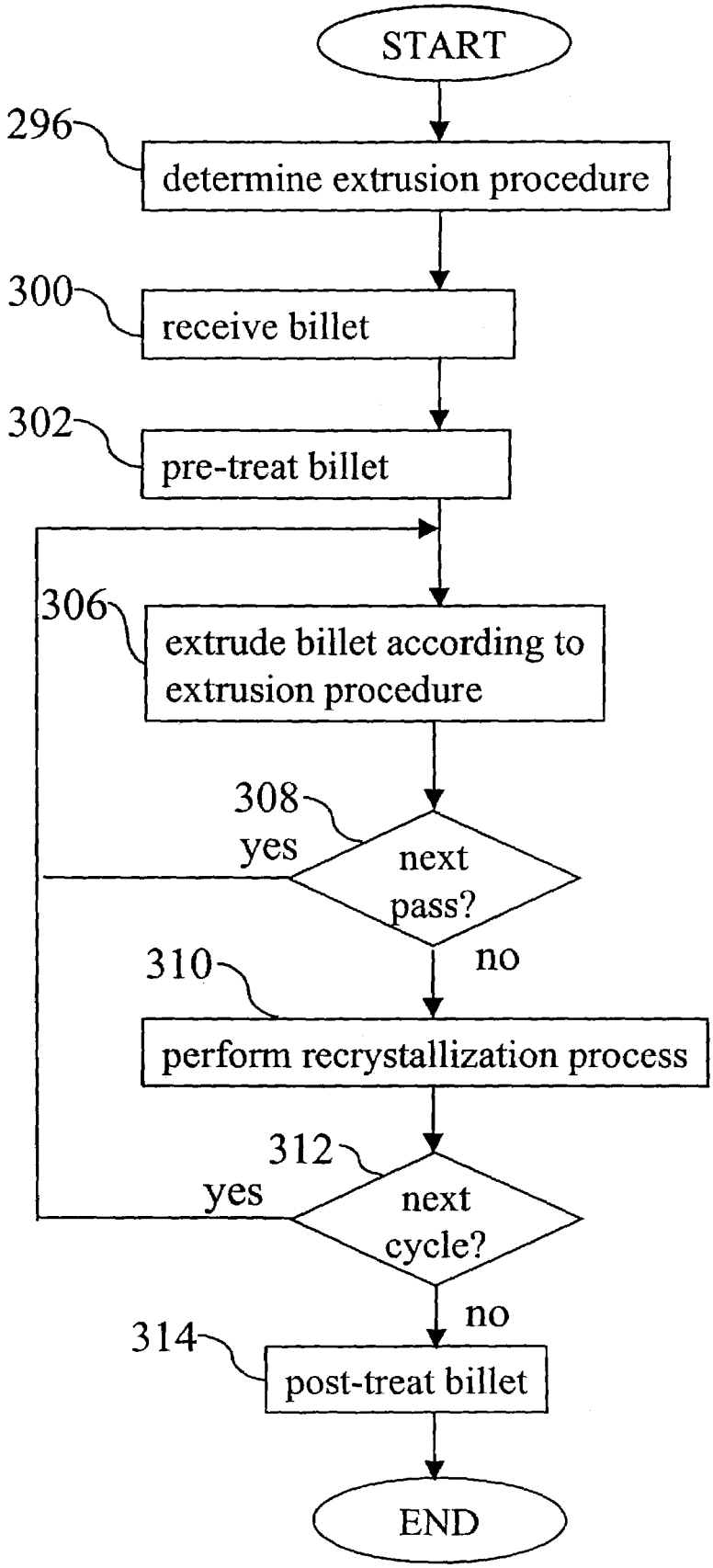
FIG. 3 is a flowchart illustrating one embodiment of a method for developing the texture of a material.

Example embodiments of the present invention and their advantages are best understood by referring to FIGS. 1–3 of the drawings, in which like numerals refer to like parts.

FIG. 1 is a schematic of one embodiment of an equal channel angular extrusion (ECAE) system 100 for developing the texture of a material. ECAE system 100 is utilized to transform cast material microstructure into a different microstructure. For example, ECAE system 100 may be used to develop the texture of a billet 102 to improve the uniformity of the texture. A uniform texture may be desired for subsequent mechanical processing steps of billet 102.

Billet 102 may have any suitable shape and any suitable size, and may comprise any suitable material type. Material types may include materials that solidify with a large grain size and may be highly textured or have non-uniform texture, such as superalloys, refractory metals and alloys, and pure metals. For example, billet 102 may comprise materials such as molybdenum, niobium, tantalum, copper, iron, or bismuth-telluride ($Bi_2Te_3$). As applied to billet 102, "texture" refers to the coordinated orientation of the crystal grains of billet 102.

ECAE system 100 includes an ECAE die 104 having an inlet channel 106 and an outlet channel 108, the axes of which form an ECAE die angle 110. ECAE die 104 may have any suitable size and shape, and may be formed from any suitable material. Inlet channel 106 and outlet channel 108 may have nominally the same dimensions and cross-sectional area, which are typical in the conventional ECAE process (hence the name "equal channel"). The similar cross-sectional dimensions of inlet channel 106 and outlet channel 108 allow for multiple extrusions using the same die with comparably low punch pressures and loads. In the illustrated embodiment, ECAE die angle 110 is approximately 90°. Other suitable angles, however, may be utilized.

Inlet channel 106 and outlet channel 108 configured at ECAE die angle 110 create a shear plane 112 at the transition from inlet channel 106 to outlet channel 108. The transition functions to plastically deform the material of billet 102 as billet 102 passes through shear plane 112. An extrusion of billet 102 through inlet channel 106 and outlet channel 108 is referred to in the conventional ECAE process as a "pass." For each pass, billet 102 experiences a strain. For example, a strain of approximately 1.16 is produced through a die with a 90° angle.

To illustrate the simple shear to which billet 102 is subjected, a face of an original volumetric material element 114 of billet 102 is illustrated within inlet channel 106 to be generally cubic. For clarity, material element 114 may be thought of as a single grain of billet 102. After passing through shear plane 112, material element 114 is sheared to yield a sheared material element 116. In essence, the grains of billet 102 elongate as a result of a single pass through shear plane 112.

The strain at shear plane 112 may be substantially uniform, which may yield substantially uniform material properties such as texture throughout billet 102. In the case of multiple extrusions, the total strain intensity $\epsilon_n$ after N passes may be described by Equation (1):

$$\epsilon_n = N \cdot \Delta\epsilon_i \quad (1)$$

where $\Delta\epsilon_i$ represents the incremental strain intensity that the material undergoes after each pass, defined by Equation (2):

$$\Delta\varepsilon_i = \frac{2}{\sqrt{3}} \cdot \cot\Phi \quad (2)$$

During multiple extrusions, shear plane 112 may be changed by changing the orientation of billet 102 by, for example, rotating billet 102 in between passes. By changing the orientation of the shear plane 112 with respect to the original billet orientation, a variety of different microstructures and textures can be developed in a controlled manner. An extrusion route may be used to define the billet rotation direction and the amount of rotation for each pass of a sequence of passes.

A pressure 118 is applied to the top of billet 102 in order for billet 102 to be extruded through inlet channel 106 and outlet channel 108. Pressure 118 may be applied by any suitable method, such as a punch technique, hydrostatic technique, or other suitable technique. The amount of pressure 118 is dependent upon the billet material and processing parameters. For a die angle of 90° and no friction, the punch pressure may approximate 1.16 times the flow stress of the material. Friction reducing measures may decrease the punch pressure by a factor of 1.5 to 2 over conventional extrusion processes. Area effects can cause the overall punch load to decrease by as much as a factor of 10 to 15 over conventional extrusions to achieve the same level of added true strain.

The material properties of billet 102 may be controlled via many process parameters, such as extrusion temperature, extrusion speed, ECAE die angle 110, or other suitable parameters. According to one embodiment, extrusion is performed at room temperature. According to another embodiment, an extrusion temperature at or near the recrystallization temperature of the material of billet 102 is utilized. Accordingly, dynamic recrystallization may be achieved during extrusion. According to other embodiments, the extrusion temperature is either substantially below or substantially above the recrystallization temperature of the material of billet 102. Any suitable extrusion speed may be utilized, and may be dependent upon the temperature and material properties. For example, in an embodiment where $Bi_2Te_3$ is utilized, an extrusion speed within a range of approximately 0.01 to 1.0 inches per minute may be utilized.

Modifications, additions, or omissions may be made to the system without departing from the scope of the invention. For example, although ECAE die angle 110 is illustrated as approximately 90°, other suitable angles may be utilized.

In summary, ECAE system 100 may be used to effectively and efficiently develop textures in a variety of materials. For example, texture may be developed in thick plate, long bar, or other types of large product cross sections. Moreover, the number of ECAE passes and heat treatments required to perform a texture conversion is reasonable, so texture conversion may be performed rapidly. Additionally, the equipment requirements for a given volume of material may be less than needed to accomplish the same conversion using conventional equipment.

FIGS. 2A through 2E illustrate example billet orientations at the start of the first pass and of a subsequent pass for multiple pass ECAE processing. Referring to FIGS. 2A and 2B, FIG. 2A illustrates billet 102 at an initial orientation about its long axis 204 prior to being extruded through ECAE die 104, and FIG. 2B illustrates billet 102 after being extruded through ECAE die 104, thereby completing a first pass.

Referring to FIG. 2A, a shaded area 200 represents a top of billet 102 during the first pass. A side 202 faces a zero degree orientation. Shaded area 200 moves from the top of billet 102 to a side 202 of billet 102 at the completion of the first pass, as illustrated in FIG. 2B. Referring to FIG. 2B, a cross-hatched area 205 and volumetric regions 206 and 207 regions represent processed and unprocessed material, respectively. Fully strained ECAE processed material is located behind cross-hatched area 205. Unprocessed volumetric regions 206 and 207 are located at each end of billet 102.

For subsequent passes, conventional ECAE processing recognizes four separate extrusion routes, Routes A, B, C, and C' (also known as D), three of which are illustrated in FIGS. 2C through 2E. Route X processing may be referred to as "nX", where n represents the number of passes experienced by billet 102, and X represents the route name.

FIG. 2C illustrates one embodiment of Route A processing. According to Route A processing, billet 102 is inserted into inlet channel 106 for subsequent passes with the same orientation about long axis 204 that was used during the first pass. In other words, billet 102 is not rotated about long axis 204 for subsequent passes. With reference to FIG. 2A, side 202 of billet 102 faces the same zero degree orientation as was used during the first pass. For Route A processing, the texture obtained for the material of billet 102 is similar to a texture obtained from a conventional rolling process.

FIG. 2D illustrates one embodiment of Route B processing. According to Route B processing, billet 102 is rotated either plus 90° or minus 90° about long axis 204 from its starting position before being inserted into inlet channel 106 for a second extrusion. In the illustrated embodiment, billet 102 is rotated plus 90°. For a third pass for Route B, billet 102 is rotated 90° about long axis 204 in a direction opposite from the rotation direction of the second pass. The texture obtained for the material of billet 102 in Route B processing is similar to a texture obtained from a conventional drawing process.

FIG. 2E illustrates one embodiment of Route C processing. According to Route C processing, billet 102 is rotated 180° in either direction from its starting position before being inserted into inlet channel 106 for a second extrusion. For Route C processing, the texture obtained is a "shear" texture and is minimized as compared to the texture obtained as a result of either Route A, Route B, or a combination of these two routes.

Route C' (also known as Route D) is another route that is conventional to ECAE processing. Route C' involves rotating billet 102 either plus 90° for four consecutive passes or minus 90° for four consecutive passes.

TABLE 1 lists examples of as-worked textures resulting from processing according to Routes A, B, C, and C', where (hkl) represents a plane, and [uvw] represents a direction.

TABLE 1

| Material Crystal Structure | Prototype Metal | ECAE Route | As-Worked Texture |
|---|---|---|---|
| BCC | Fe | A | (001)[110] (common sheet texture)<br>(001) parallel to Longitudinal Plane<br>[110] parallel to Transverse (Extrusion) |

TABLE 1-continued

| Material Crystal Structure | Prototype Metal | ECAE Route | As-Worked Texture |
|---|---|---|---|
| | | | Direction |
| | | B | [110] parallel to Transverse (Extrusion) Direction |
| | | C | Torsion |
| | | C' | Weak [110] parallel to Transverse (Extrusion) Direction |
| | Ta | A | (001)[110] and (112)[110]<br>(001) and (112) parallel to Longitudinal Plane<br>[110] parallel to Transverse (Extrusion) Direction |
| | | B | [110] parallel to Transverse (Extrusion) Direction<br>[110] and [111] 2 Flow Direction |
| | | C | Weak [110] parallel to Transverse (Extrusion) Direction<br>[110] parallel to Flow Direction (Torsion like texture) |
| | | C' | Very weak texture<br>Near [110] and [133] parallel to Transverse Direction<br>Near [110] parallel to Flow Direction |

Alternatively, {hkl} may represent a plane, and <uvw> may represent a direction. TABLE 1 illustrates that multi-pass ECAE processing may produce as-worked textures similar to those developed by conventional means.

FIG. 3 is a flowchart illustrating one embodiment of a method for developing the texture of a material. The method may be used to develop different textures of billet 102 by controlling the level of strain, the orientation of strain, and recrystallization conditions. Controlling the level of strain involves controlling the number of passes. Controlling the orientation of strain involves determining an appropriate extrusion route, for example, Route A, B, C, C', any combination of the preceding, or other suitable sequence of orientations. Recrystallization conditions may be controlled by performing the ECAE passes while the workpiece is at a specific temperature and for a specified amount of time. By controlling these variables, any suitable texture such as a highly texturized microstructure with a fine grain size may be developed for a material.

The method begins at step 296, where an extrusion procedure is determined. The extrusion procedure outlines a sequence of extrusion routes and treatments that are to be performed. The extrusion route may comprise, for example, Route A, B, C, C', any combination of the preceding, or other suitable sequence of orientations. The treatments may comprise any suitable treatment that prepares billet 102 for the extrusion process or other process. The sequence may comprise one or more cycles of one or more extrusion passes and treatments.

The number of passes may depend on, among other factors, the material of the billet. For example, pure tantalum has extraordinary workability and may be subjected to at least eight successive extrusions at room temperature without intermediate annealing. The microstructure of initially coarse-grained tantalum may appear uniform after two extrusions. Extremely large-grained cast tantalum may exhibit a uniform microstructure after four extrusions.

Billet 102 is received at step 300. Billet 102 may comprise, for example, copper. Billet 102 is pre-treated at step 302. Pre-treating may involve a thermal, mechanical, or thermo-mechanical treatment or other process suitable for preparing billet 102 for the extrusion process. For example, billet 102 may be heat treated under argon for approximately sixty minutes at 50° to 400° Celsius.

Billet 102 is extruded according to an extrusion route of the extrusion procedure at step 306. If there is a next pass of an extrusion route of the extrusion procedure at step 308, the method returns to step 306 to extrude billet 102 according to the next pass. If there is no next pass, the method proceeds to step 310, where a recrystallization process is performed on billet 102. For example, billet 102 may be heat treated in a vacuum for approximately nine minutes at 225° to 250° Celsius to perform recrystallization.

If there is a next cycle of the extrusion procedure at step 312, the method returns to step 306 to extrude billet 102 according to the extrusion procedure. For example, the cycle of extrusion passes followed by recrystallization may be repeated two, four, or more times to achieve the desired level of microstructural refinement and texture. If there is no next cycle, the method proceeds to step 314.

Billet 102 is post-treated at step 314. Post-treating may involve preparing billet 102 for a next stage of manufacturing. For example, the end zones and near surface regions of billet 102 may not achieve the same level of texture conversion as the midsection of billet 102. These end zones and near surface regions may be removed to prepare billet 102 for a next stage of manufacturing. After post-treating the billet, the method terminates.

Modifications, additions, or omissions may be made to the method without departing from the scope of the invention. For example, modifications may be made if the workpiece end zones and some near surface regions do not achieve the same level of texture conversion as the midsection of the workpiece. According to one example embodiment, the resulting texture may be made more uniform for a workpiece by using dummy billets at each end of the workpiece. Alternatively or additionally, billets 102 may be processed sequentially in a semi-continuous fashion. According to another example embodiment, the workpiece material may be encapsulated in a can with wall and end regions of sufficient thickness to remedy the problem. Additionally, steps may be performed in any suitable order without departing from the scope of the invention.

According to one example of the method, billets are processed according to Routes A, B, C, or C' to develop the texture of the billets. In the example, the billets comprise three types of tantalum billets. Cast A billets exhibit large columnar grains that are oriented at an angle to the long axis. Cast B billets exhibit large grains oriented along the long axis. Coarse-grained billets have a grain size of 145 $\mu$m, with large grains (~214 $\mu$m) near the surfaces and small grains (75 $\mu$m) in the center of the billets.

The following presents example descriptions of microstructure and texture after extruding the billets according to Routes A, B, C, and C'. The billets may be extruded at room temperature at a speed of 0.2 inch per second using one-inch tooling and using Permatex Antiseize as a lubricant.

For Route A processing, the grains of the coarse-grained billets may be uniformly elongated at an angle of about 26 degrees to the extrusion axis after one pass, and the grain boundaries may still be visible. The gradient in grain size from the surface to the center may be visible after two extrusion passes. After two passes, the overall structure may be more uniform than after one pass. After four and eight passes, grains may be extremely elongated, and the initial grains may no longer be distinguished. Instead, flow lines may become visible and may be oriented at angles of approximately six and three degrees to the extrusion axis.

Route A processing of coarse-grained Fe billets may yield a very strong and pronounced texture that includes texture components {001}<110> and {112}<110>. After one extrusion pass, the billets may exhibit an incomplete α-fiber with dominant orientations at {001}<110> and {112}<110> and a weak y-fiber characterized by all orientations having <111> parallel to the rolling/transverse direction. During subsequent passes, the α-fiber may be strongly enhanced whereas the γ fiber may be totally diminished. After two extrusion passes, an additional Goss-component may be observed. After four and eight extrusion passes, the billet may exhibit a β-fiber containing the Taylor-orientation for bcc metals.

The microstructure for the cast billets after one Route A extrusion pass may differ significantly from the microstructure for the coarse-grained billets. The cast billets may exhibit several regions of different microstructures, as well as slip lines, deformation bands, and twinning. After four extrusion passes, the microstructure may be homogeneous over the entire surface, and flow lines may be visible.

After one extrusion pass according to Route A, the cast Ta billet may exhibit a very strong and sharp texture. Textures may appear near {223}<122> and {230}<320> for Cast A billets and Cast B billets, respectively. Subsequent to four extrusion passes, the Cast A tantalum may develop a strong texture with orientations that belong to the α-fiber, where the α-fiber extends from {113}<110> over {112}<110> to (223}<110> with maximum intensities near {112}<110>. The texture for Cast B billets after four passes may resemble the texture observed for the coarse-grained billets after two passes. The billets may exhibit a weak Goss component, a strong incomplete α-fiber, a weak γ fiber, and a weak preference for {111}<112> on the γ-fiber.

For Route B processing, the effect of the number of passes on the microstructure of the flow plane of the coarse-grained billets may be similar to the effect for Route A processing. Route B processing may elongate grains in the flow direction and may develop laminar microstructures such as flow lines on the flow plane. The microstructures of the cast billets after four extrusion passes may be very fine with no significant differences for the different planes. Cast billets processed according to Route B may exhibit a similar texture after four passes. Maximum intensities may be seen for grains to orient with their <110> crystal axis along the flow direction of the billets. In the transverse direction, grains may tend to orient with their <100> axis.

For Route C processing, the grains of the coarse-grained billets may be heavily deformed, but retain approximately their initial grain shape at even numbered passes. The boundaries of original grains may be visible, but not as prominent as in the initial material. The microstructures for the cast billets may be very fine after four passes.

A billet processed by Route C may exhibit dominant orientations <110> and <100> to align with the transverse direction of the billet. These orientations may be the dominant orientations to align parallel to the flow direction of the billets. The main texture components may be present throughout the full cross-section of the billet, yielding a uniform texture.

For Route C' processing, extrusions may yield a highly refined and homogeneous microstructure. A modest refinement in the structure may occur between four and eight passes. Additionally, the coarse-grained billets processed by Route C' may exhibit a weak texture in comparison to the texture of the billets processed by Route A. Maximum intensities may be less than two times random. Dominant orientations that align parallel to the transverse direction may be <100>, <133>, and <111>. After eight Route C' passes, the cast billets may exhibit no general preference for any particular orientation. Furthermore, the cast billets may tend to align <110> with the flow direction of the billet. The deviation from that ideal orientation points toward <112> and <113>.

According to another example of the method, billets comprising copper are subject to Route A, B, C, and 2C*2C processing. The main texture components for billets subject to Route A processing may be similar to those seen in rolled copper. The texture may be near the {110}<122> orientation, where {100} is parallel to the longitudinal plane and <122> is parallel to the extrusion direction.

Billets processed according to Route B may exhibit the partial fiber textures of <122> and <100> along the transverse direction (extrusion direction) with a higher proportion of the <122> fiber. This texture, however, may not as pronounced as a typical drawing texture. Billets processed according to Route C may exhibit a sheet texture near the ideal orientations {110}<111>+{110}<100>. The texture may intensify with an increasing number of passes. The reversal strain applied during the even passes of Route C might not substantially affect the texture obtained during a previous pass.

Route 2C*2C may yield similar texture features in the longitudinal plane as formed from Route B. The rotation of 90° during extrusion causes a relatively strong partial fiber texture <111> along the transverse direction. Routes 2C*2C and 4A may be used to converge different initial textures. Additionally, recrystallization heat treatment may be used to yield the same final texture regardless of the initial texture of the billet, and thus may be used to converge different initial textures.

Certain embodiments of the invention may provide one or more technical advantages. A technical advantage of one embodiment may be that a uniform texture can be produced throughout the majority of a cross section or volume of a workpiece. Uniform microstructure such as uniform grain size or grain morphology in recrystallized material may also be produced. The resulting texture and microstructure may be independent of the initial texture and microstructure of the workpiece.

Although embodiments of the invention and some of their advantages are described in detail, a person skilled in the art could make various alterations, additions, and omissions without departing from the spirit and scope of the present invention as defined by the appended claims.

What is claimed is:

1. A method for developing a texture of a material, comprising:

receiving a billet of material, the billet having an initial texture, the billet associated with an extrusion procedure comprising one or more extrusion routes, the one or more extrusion routes having one or more passes;

repeating the following for each route of the one or more extrusion routes:

repeating the following for each pass of the one or more passes to transform the initial texture to a developed texture of the billet:

extruding the billet through an inlet channel of an equal channel angular extrusion die according to the one or more extrusion routes; and extruding the billet through an outlet channel of the equal channel angular extrusion die according to the one or more extrusion routes; and performing a heat treatment recrystallization procedure on the billet having the developed texture to transform the developed texture to a recrystallized developed texture.

2. The method of claim 1, wherein the developed texture is more uniform than the initial texture.

3. The method of claim 1, wherein the one or more extrusion routes comprises an extrusion route selected from a group consisting of Route A, Route B, Route C, and Route C'.

4. The method of claim 1, wherein the material comprises a member selected from a group consisting of copper and tantalum.

5. The method of claim 1, further comprising applying a uniform strain to the billet at a shear plane of the equal channel angular extrusion die.

6. The method of claim 1, further comprising treating the billet under argon at a temperature between 50 and 400 degrees Celsius.

7. The method of claim 1, wherein the heat treatment recrystallization procedure is performed at a pressure below atmospheric pressure.

8. A system for developing a texture of a material, comprising:

means for receiving a billet of material, the billet having an initial texture, the billet associated with an extrusion procedure comprising one or more extrusion routes, the one or more extrusion routes having one or more passes;

means for repeating the following for each route of the one or more extrusion routes:

means for repeating the following for each pass of the one or more passes to transform the initial texture to a developed texture of the billet:

extruding the billet through an inlet channel of an equal channel angular extrusion die according to the one or more extrusion routes; and extruding the billet through an outlet channel of the equal channel angular extrusion die according to the one or more extrusion routes; and means for performing a heat treatment recrystallization procedure on the billet having the developed texture to transform the developed texture to a recrystallized developed texture.

9. A method for developing a texture of a material, comprising:

receiving a billet of material, the material comprising a member selected from a group consisting of copper and tantalum, the billet having an initial texture, the billet associated with an extrusion procedure comprising one or more extrusion routes, the one or more extrusion routes comprising an extrusion route selected from a group consisting of Route A, Route B, Route C, and Route C', the one or more extrusion routes having one or more passes; and repeating the following for one or more cycles of the extrusion procedure:

repeating the following for each pass of the one or more passes to transform the initial texture to a developed texture of the billet, the developed texture being more uniform than the initial texture: extruding the billet through an inlet channel of an equal channel angular extrusion die according to the one or more extrusion routes, and extruding the billet through an outlet channel of the equal channel angular extrusion die according to the one or more extrusion routes; and performing a recrystallization procedure on the billet having the developed texture to transform the developed texture to a recrystallized developed texture.

10. A method for developing a microstructure of a material, comprising:

receiving a billet of material, the billet having an initial microstructure, the billet associated with an extrusion procedure comprising one or more extrusion routes, the one or more extrusion routes having one or more passes;

heating the billet to a temperature approximately equal to or greater than the recrystallization temperature of the billet of material;

repeating the following for each pass of the one or more passes to transform the initial microstructure to a developed microstructure of the billet:

extruding the heated billet through an inlet channel of an equal channel angular extrusion die according to the one or more extrusion routes; and extruding the heated billet through an outlet channel of the equal channel angular extrusion die according to the one or more extrusion routes.

11. The method of claim 10, wherein the developed microstructure is more uniform than the initial microstructure.

12. The method of claim 10, further comprising repeating the following for one or more cycles of the extrusion procedure:

the step of repeating the following for each pass of the one or more passes to transform the initial microstructure to a developed microstructure of the billet.

13. The method of claim 10, wherein the one or more extrusion routes comprises an extrusion route selected from a group consisting of Route A, Route B, Route C, and Route C'.

14. The method of claim 10, wherein the material comprises a member selected from a group consisting of copper and tantalum.

15. The method of claim 10, further comprising applying a uniform strain to the billet at a shear plane of the equal channel angular extrusion die.

16. The method of claim 10, further comprising performing a recrystallization procedure on the billet having the developed microstructure to transform the developed microstructure to a recrystallized developed microstructure.

17. The method of claim 16, wherein the recrystallization procedure includes heat treating the billet for a length of time.

18. The method of claim 10, further comprising treating the billet under argon at a temperature between 50 and 400 degrees Celsius.

19. A system for developing a microstructure of a material, comprising:

means for receiving a billet of material, the billet having an initial microstructure, the billet associated with an extrusion procedure comprising one or more extrusion routes, the one or more extrusion routes having one or more passes;

means for heating the billet to a temperature approximately equal to or greater than the recrystallization temperature of the billet of material;

means for repeating the following for each pass of the one or more passes to transform the initial microstructure to a developed microstructure of the billet:

extruding the heated billet through an inlet channel of an equal channel angular extrusion die according to the one or more extrusion routes; and extruding the heated billet through an outlet channel of the equal channel angular extrusion die according to the one or more extrusion routes.

20. A method for developing a microstructure of a material, comprising:

receiving a billet of material, the material comprising a member selected from a group consisting of copper and tantalum, the billet having an initial microstructure, the billet associated with an extrusion procedure comprising one or more extrusion routes, the one or more extrusion routes comprising an extrusion route selected from a group consisting of Route A, Route B, Route C, and Route C', the one or more extrusion routes having one or more passes; and repeating the following for one or more cycles of the extrusion procedure:

repeating the following for each pass of the one or more passes to transform the initial microstructure to a developed microstructure of the billet, the developed microstructure being more uniform than the initial microstructure: extruding the billet through an inlet channel of an equal channel angular extrusion die according to the one or more extrusion routes, and extruding the billet through an outlet channel of the equal channel angular extrusion die according to the one or more extrusion routes; and performing a recrystallization procedure on the billet having the developed microstructure to transform the developed microstructure to a recrystallized developed microstructure.

* * * * *